US005613447A

United States Patent [19]

Trickett

[11] Patent Number: 5,613,447

[45] Date of Patent: Mar. 25, 1997

[54] SLIP SHEET FOR TRANSPORTING GOODS

[76] Inventor: Howard J. Trickett, 2699 Pontius Rd., Hartville, Ohio 44632

[21] Appl. No.: 399,490

[22] Filed: Mar. 7, 1995

Related U.S. Application Data

[63] Continuation-in-part of Ser. No. 154,308, Nov. 18, 1993, abandoned.

[51] Int. Cl.[6] ..... B65D 19/00

[52] U.S. Cl. ..... 108/51.1; 108/56.1; 108/901; 206/596

[58] Field of Search ..... 108/51.1, 51.3, 108/56.1, 901, 27, 902; 206/596, 598, 599, 386

[56] References Cited

U.S. PATENT DOCUMENTS

| | | | |
|---|---|---|---|
| D. 237,468 | 11/1975 | Andrews | D9/294 |
| 2,774,490 | 12/1956 | Strong | 108/51.3 X |
| 2,913,206 | 11/1959 | Paris | 108/51.1 X |
| 2,960,244 | 11/1960 | Strong | 206/598 |
| 3,282,621 | 11/1966 | Peterson | 206/386 X |
| 3,776,145 | 12/1973 | Anderson | 108/51 |
| 3,850,115 | 11/1974 | Mackes | 108/51 |
| 3,850,116 | 11/1974 | Mackes | 108/51 |
| 4,042,127 | 8/1977 | Brossia | 214/10.5 R |
| 4,300,867 | 11/1981 | Frees | 414/493 |
| 4,405,673 | 9/1983 | Fridley et al. | 108/51.3 X |
| 4,570,546 | 2/1986 | Batelka | 108/51.3 X |
| 4,649,007 | 3/1987 | Bonis | 264/148 |
| 4,735,153 | 4/1988 | Wong | 108/51.1 |
| 5,062,370 | 11/1991 | Etlinger | 108/51.3 |
| 5,111,754 | 5/1992 | Adams, Jr. | 108/51.3 |
| 5,226,372 | 7/1993 | Frenkel | 108/51.1 |
| 5,383,408 | 1/1995 | Searcy | 108/51.1 |

FOREIGN PATENT DOCUMENTS

| | | | |
|---|---|---|---|
| 5051037 | 3/1993 | Japan | 108/51.1 |
| 800453 | 8/1958 | United Kingdom | 108/51.3 |
| 9100831 | 1/1991 | WIPO | 108/51.1 |

*Primary Examiner*—Peter M. Cuomo
*Assistant Examiner*—Janet M. Wilkens
*Attorney, Agent, or Firm*—Oldham & Oldham Co. L.P.A.

[57] ABSTRACT

A transport unit for natural rubber comprises a slip sheet; a plurality of individual rectangular solid bales formed of natural rubber, stacked upon the slip sheet so as to form a rectangular solid unit; and at least one layer of a stretchable polymeric film wrapped around the sides and top of the rectangular solid unit to hold the unit together. The preferred slip sheet has a rectangular working area for stacking of the bales, particularly where the working area of the slip sheet is about 54 inches wide by 41 inches long. The slip sheet is formed from a polymeric material, especially a recyclable material, and most especially a previously-processed polymer, such as a polyolefin or a polyester. The slip sheet is manufactured from a material that is not attractive to insects for nutritive or nesting purposes, to discourage insect infestation. The transport unit comprises from about thirty to about forty-two bales, each of the individual rectangular solid bales weighing between seventy and eighty pounds. The transport unit has the individual bales stacked in from about five to about seven layers comprising six bales per layer. The weight of non-rubber material comprises less than about 4 percent of the total weight of the transport unit, and preferably, the weight of non-rubber material comprises less than about 2 percent of the total weight of the transport unit. The preferred slip sheet has four upstanding walls to assist retaining the bales on the slip sheet and has two compressible tabs to aid in grasping them.

10 Claims, 4 Drawing Sheets

SLIP SHEET FOR TRANSPORTING GOODS

This is a continuation-in-part of application Ser. No. 08,154,308 filed on 18 Nov. 1993, now abandoned.

The present invention relates to a novel slip sheet for the transport goods, particularly rubber, in a safe, economic and environmentally-sound manner. More particularly, the present invention relates to a novel slip sheet for transporting goods such as rubber that eliminates the previous need for the use of wooden crates or pallets.

BACKGROUND ART

The international geography of the rubber industry immediately teaches one that the transport of rubber in an economic and environmentally-sound manner is a requisite in today's world. Over eighty percent of the world's natural rubber production is from the Pacific Rim area, specifically Thailand, Malaysia and Indonesia. But about seventy-five percent of the world's users for natural rubber are found in North America, Europe and Japan. Connecting the producer with the user is only possible by the use of large scale transport methods, such as ocean freighter, and particularly, the use of containerized barge and break-bulk transport in association with ocean freighters.

The current art for transporting rubber is to initially process the latex into a product known in the industry as "TSR Crumb" (Technical Specification Rubber Crumb). Up to the 1960's, rubber was shipped in large bales. Prior to the switch to TSR crumb, rubber was packaged in large loose bales weighing about 250 pounds each. In fact, a certain percentage of the rubber is still transported in this manner. With the switch to TSR crumb, the change in the transport method involved a switch to smaller bales in the range of about 70 to 80 pounds each, although even smaller bales are sometimes preferred, especially for shipment from or into locations where people of smaller stature will be handling the bales. Between 30 to 42 of these bales could be packed in wood crates or on wood pallets for shipment. Differences in the shipping preferences of different producers and consumers resulted in discrepancies in shipping policies. More importantly, wood shipping containers, such as crates or pallets, have provided several problems in the past and newer problems are emerging.

When the rubber was shipped in wood crates, the crates could be stacked four units high, efficiently filling the hold of a transport carrier, such as in a "break bulk" ship. However, the use of crates and/or pallets means that either the crates or pallets need to be transported to the production site for loading or they have to be manufactured in the vicinity of the production site. While wood is certainly available near many rubber production sites, the environmental concerns of deforestation militate against such production. If the crates or pallets need to be shipped to the site, the shipper must take the crates or pallets in lieu of an active cargo, effectively cutting the efficiency of the trip. Additionally, the wood in the crates is subject to infestation by wood borers and insects, which can introduce unwanted and harmful insects into the ecosystem. Further, the weight of the wood in the crates or pallets presents additional weight during shipment of the rubber itself. If this weight could be minimized or eliminated, more rubber could be shipped in a given load.

Some rubber shippers have taken to replacing wood crates with metal crates that lack tops, but are formed so that the bottom of one hingedly attaches to the open top of the metal crate below. While eliminating the problems of infestation or deforestation, this solution does little to prevent the ships from operating at less than optimal capacity, unless the shipper can find a product that can be effectively transported in the metal crates on the trip out to pick up the rubber. Also, as long as the rubber is packed in the metal crate, a substantial portion of the total weight being transported is the dead weight represented by the metal crate.

One alternative to metal or wooden crates is the use of palletized loads. In a shrink-wrapped pallet, at least fifty percent of the wood used in a wood crate can be eliminated, and a pallet can also effectively transport between 30 to 42 of the small bales of 77 pounds each. The rubber product is very sensitive to the pressure resulting from stacking, however. Therefore, both the height of the individual pallet and the ability to stack the pallets one upon the other are both negatively influenced by the tendency of the rubber to fuse and flow from the pressure. The wood pallets are limited to single stacking, although some double stacking will occasionally be done. In either case, valuable head space, particularly in warehouses, goes untilled. In addition, the wood pallets still present the problems of transporting wood crates, such as possible infestation. Even further, some countries, notably Germany, have enacted environmental regulations that essentially have banned the use of one-way wood pallets or crates.

Another problem posed by the older techniques of shipping using wood pallets and wood crates relates to the use of containerized shipping. For example, a pallet or crate having 36 bales of rubber weighing 77 pounds each constitutes 2772 pounds or about 1260 kilograms of rubber, exclusive of the packaging. Sixteen such pallets or crates weigh 44,352 pounds or 20,160 kilograms, again, exclusive of the packaging. In containerized shipping, the overall weight of the container, not the "live" freight weight, must be accounted for in the costs of shipping. If the container must ship with only 15 pallets or crates instead of sixteen, the effective cost of shipping increases over 6%. To look at it in a slightly different manner, to constitute 6% of the total weight of a loaded wooden crate where the rubber on the crate weighs 2772 pounds, the crate would only have to weigh about 175 pounds, which is a quite realistic number. In view of this, the incentives to reduce or entirely eliminate the use of wood are clear, although the inventor is not aware of any others using the type of innovative techniques taught herein.

SUMMARY OF THE INVENTION

It is, therefore, a first object of the present invention to provide a slip sheet useful in the transport of goods, including bulk rubber in crumb and sheet form, without the use of wood packaging materials.

A second object of the present invention is to provide a method of transporting goods, including rubber, that is economic and environmentally-sound.

These are further objects of the present invention are achieved by a slip sheet, particularly one formed from a flat sheet of polymeric material, comprising a flat surface for receiving goods, each edge of the flat surface having an upstanding wall portion affixed thereto; and at least one edge of the flat surface having a compressible tab portion extending outwardly therefrom. In the most preferred embodiment, the compressible tab portion has an airfoil-type cross-sectional area, formed by folding the flat sheet of polymeric material back on itself and affixing it to itself.

BRIEF DESCRIPTION OF THE DRAWINGS

Better understanding of the present invention will be achieved by reference to the accompanying drawings, which are made a part hereof, in which identical parts are designated by identical part numbers and in which.

DETAILED DESCRIPTION OF THE DRAWINGS

The method of transporting natural rubber in crumb and sheet form will be best understood when one first understands the natural rubber itself, which is generally a product of the tree *Hevea brasiliensis*. While synthetic rubbers have been developed, many applications still require the use of natural rubber, particularly the production of radial tires. The synthetic rubbers were developed during and after World War II, when U.S. companies determined to not be totally dependent on the Pacific Rim sources for natural rubber. However, the natural rubber sources are still a very important economic factor in world rubber production. A properly operated rubber plantation can produce in excess of 3000 pounds of rubber per acre per year, although the collecting and processing of the rubber can be very labor-intensive. In a rubber plantation, the trees are tapped in a manner to allow a rich white liquid, known as latex, to be accumulated into cups, which must be collected frequently to avoid putrefaction or contamination of the latex, which is a relatively unstable material. Carried to collection stations, the latex is strained to remove impurities and a preservative, such as ammonia, may be added. When the latex is treated by acids or acid salts, the latex separates into two phases in a process generally referred to as coagulation. The natural rubber separates from the liquid serum as a white, dough-like mass, which is then dried and ground to form crumbs or sheets. In this form, the rubber, which is chemically characterized as cis-1,4-polyisoprene, is sufficiently stable to enable stockpiling without further preservation means. However, the rubber will fuse with itself or flow when pressure is applied, and this feature, while allowing the rubber to be formed into rectangular sheets or bales, is also an unfortunate consequence which prevents excessive stacking of the sheets or bales.

Commercial rubber users prefer the rubber to be in bales of a convenient size, which is from about seventy to about eighty pounds, although the size of the bales varies greatly, depending on the producer and consumer. Such a size can be achieved using a bale having in the range of about 1.5 to 1.8 cubic feet of volume. In a preferred embodiment for the applications taught in this invention, the dimensions of a rectangular solid bale would be about 27 inches long, about 13.5 inches wide and about 7.5 inches thick. The process of forming such a rectangular solid bale from the rubber is well known and will be well within the knowledge of one of skill in the rubber industry. Once formed, the bales are usually packaged in a plastic bag, although it is also known in the industry to package the bales in a shrink-wrap or stretch-wrap polymer, such as a polyethylene film. If for no other reason, this individual bale packaging minimizes the fusing of rubber in adjacent bales.

Figure 1:
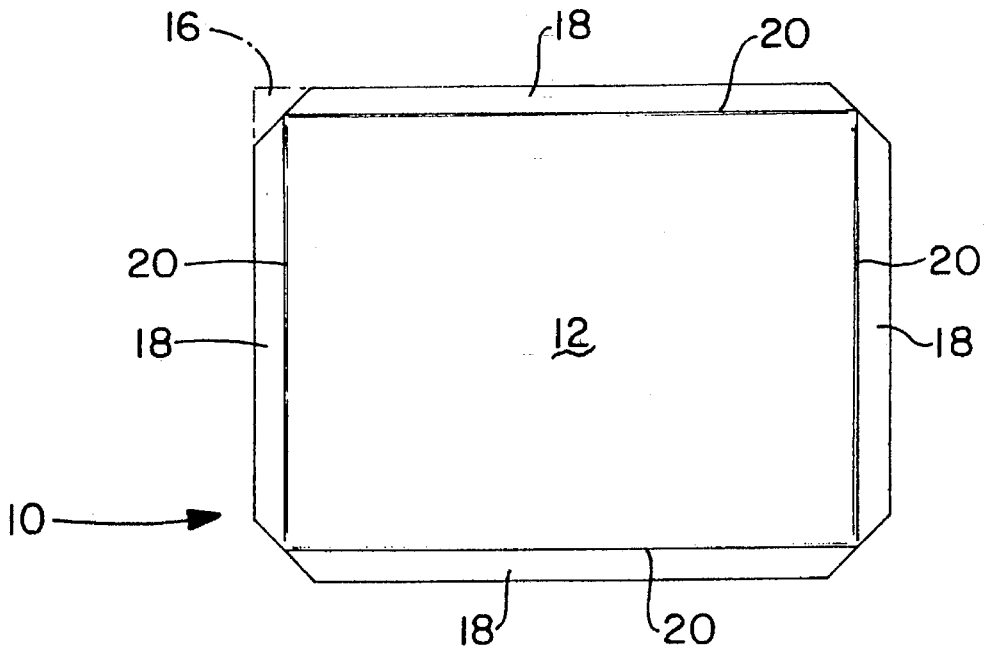
FIG. 1 shows a first embodiment slip sheet for transporting goods in unassembled top plan view.
Figure 2:
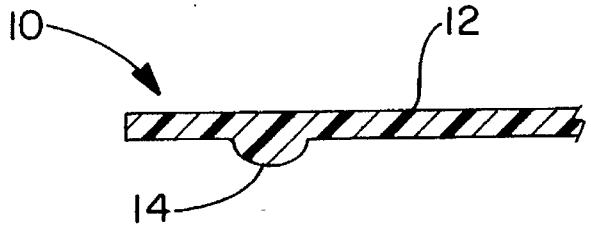
FIG. 2 shows a sectional side view through the first embodiment slip sheet for transporting rubber.

To provide a base for forming and moving the transport unit of crumb rubber bales, a slip sheet 10 is provided. The slip sheet 10 will be a non-wooden material and preferably a polymeric material, even more preferably a recyclable material. Still more preferably, the slip sheet 10 will be formed from a previously-processed polymer, that is, a polymer that has been previously subjected a thermal molding process and the degradation inherent therein. The preferred slip sheet 10 will be manufactured from a material that lacks nutritive or nesting interest, particularly to insects, thereby preventing or at least minimizing insect infestation. The preferred material will be impervious to moisture. These requirements effectively eliminate wood, corrugated paper, cardboard and similar materials from consideration. As shown in FIG. 1, a first shape of the slip sheet 10, as shown in plan view from atop, is shown, with the preferred working area or "footprint" size being a rectangular area 12 about 54 inches wide by 41 inches long. By "footprint," I mean the space upon which the rubber may be stacked and the space which the transport unit occupies. With such a footprint 12, the slip sheet 10 occupies 15.38 square feet, so a container having 246 square feet of floor space could hold sixteen such transport units. The slip sheet 10 has a thickness that is significantly less than either the width or length, so that the slip sheet is in essence a two-dimensional body. The preferred thickness for the slip sheet 10 is in the range of 0.040 to 0.060 inches. To be effective, the slip sheet 10 must have sufficient rigidity to support the load, so a minimum thickness is required, but the slip sheet should not be much thicker than required, since additional thickness adds only weight and cost to the overall transport unit. To enhance the rigidity of the slip sheet 10 and to facilitate the positioning of a loading fork under the transport unit for moving it, the slip sheet 10 will have projections 14 on the bottom surface thereof, underneath the footprint area 12. These projections 14 are shown in an enlarged side view in FIG. 2, wherein it should be kept in mind that the preferred thickness of the slip sheet 10 are in the range of 0.040 to 0.060 inches.

Polymeric materials that are useful for the slip sheet 10 include the polyolefins such as polyethylene, especially high density polyethylene ("HDPE") and polypropylene, as well as polyesters such as poly(ethylene terephthalate) ("PETE"). In addition to the use of "virgin" polymers, that is, polymer materials that have previously not been thermally processed or molded, the slip sheet 10 may well be prepared from previously-processed polymer materials. To the extent that polyolefins and polyesters are available, desirable starting materials for the slip sheet may include recycled bottles and other containers. For example, two liter soft drink bottles are produced from poly(ethylene terephthalate) and a large variety of other packaging materials comprise polyethylene, particularly high-density polyethylene.

Figure 3:
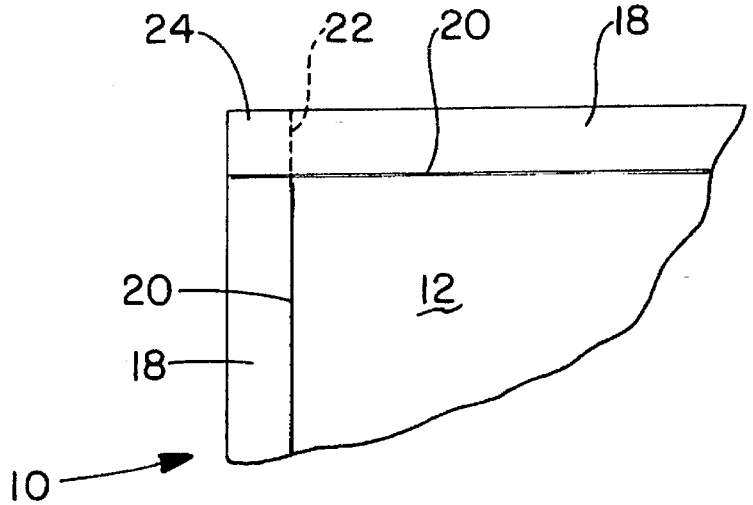
FIG. 3 shows a partial top plan view of an alternate corner design for the first embodiment slip sheet of FIG. 1.

In the first embodiment of the slip sheet 10 of the present invention is shown in FIG. 1, the slip sheet starts out as a rectangular thin sheet, with a triangular piece of material at each corner of the slip sheet having been excised, giving the slip sheet an overall eight-sided shape. One such excised triangular piece 16 is shown in the upper left corner of the slip sheet 10 in FIG. 1. In such an embodiment, the slip sheet 10 comprises a rectangular piece 12 having a trapezoidal-shaped tab 18 positioned along each of the rectangle sides, the rectangle side forming the trapezoid base. These trapezoidal tabs 18 can be folded upwardly along fold lines 20 to provide a modicum of side protection to the formed transport unit, or, more importantly, a gripping tab for the use of a push/pull type lift trucks, as discussed further below. In order to provide the preferred working area 12 of about 54 inches by about 41 inches as indicated above and to provide trapezoidal tabs 18 extending outwardly about three inches from the rectangular working area, the preferred size of the slip sheet 10 from which the triangular corners 16 are excised should be 60 inches by 47 inches. In another version of this embodiment shown in FIG. 3 as a partial view, the upper left corner of the slip sheet 10 from FIG. 1, at least one corner of the slip sheet 10 has had a straight cut 22 made into the sheet about three inches from the edge, the cut being about three inches long. When the tabs 18 of the slip sheet 10 are then folded upwardly along the fold lines 20, the rectangular tab 24 may be overlapped with the adjacent tab 18 and attached together, either through a thermal welding technique or application of a polymeric rivet, since the use of metallic rivets is not preferred, in order to facilitate recycling of the slip sheet after use.

Figure 4A:
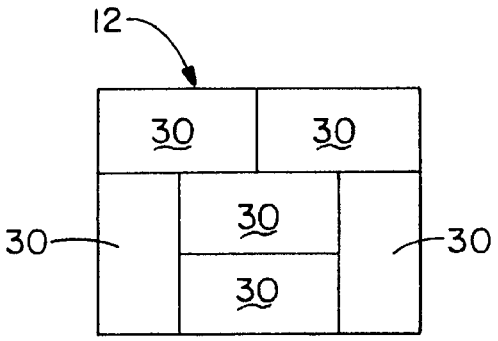
FIGS. 4A–D show, in top plan view, different arrangements for stacking bales of rubber on the slip sheet to form the transport unit.
Figure 4B:
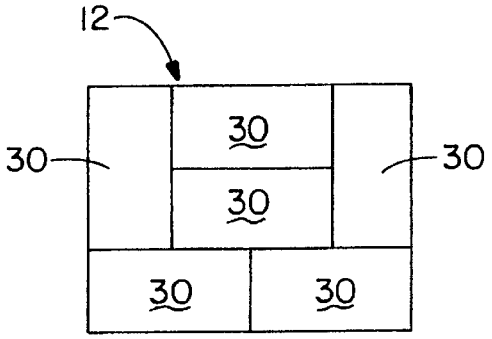
Figure 4C:
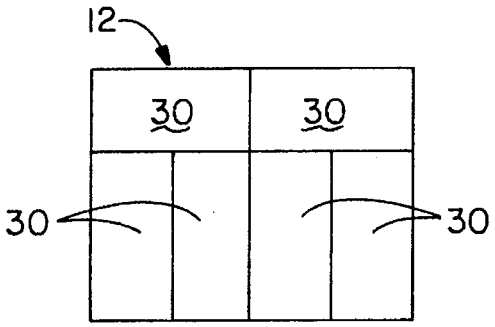
Figure 4D:
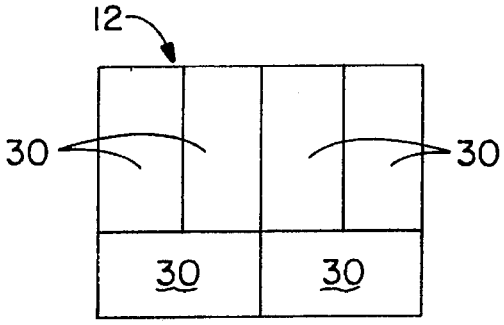

The stacking of the individual rectangular solid bales to form the transport unit for natural rubber of the present invention is shown in top plan view in FIGS. 4A–4D. Since the individual bales 30 are shaped essentially like bricks, they may be packed in a staggered formation in a similar fashion to bricks, and the stacking pattern can be shifted from one layer to the next to increase stack stability. One pattern known in the prior art is shown in FIGS. 4A and 4B. In this staggering, the layers are alternated so that layers having the configuration in FIG. 4A are placed atop layers having the configuration in FIG. 4B and vice versa. This stacking arrangement gives six bales to the layer, with the layer having a "footprint" of about 54 inches by about 41 inches. An alternate arrangement is shown in FIGS. 4C and 4D, which also provides a footprint of about 54 inches by about 41 inches. Additionally, the stacking arrangements of FIG. 4A could be used with 4C or 4D, or any other of the combinations, since they all have the same footprint 12 when placed on the slip sheet 10. When forming a stack of the bales, the number of bales in a transport unit can be varied from 30 bales to 42 bales by increasing the number of layers from five to seven. At the preferred thickness of about 7.5 inches per bale, this means that the overall transport unit will be from about 37 to about 53 inches high. In the prior art, a common practice is to interweave a layer of a polymeric material, especially a 0.14 mm thick film sheet between the layers. Such an interwoven film layer is not believed to be necessary in the present invention. A particular reason to not use the polymer film interleaving and to not stagger or alternate the bale stacking technique is to facilitate the use of robots for loading and/or unloading the bales.

Figure 5:
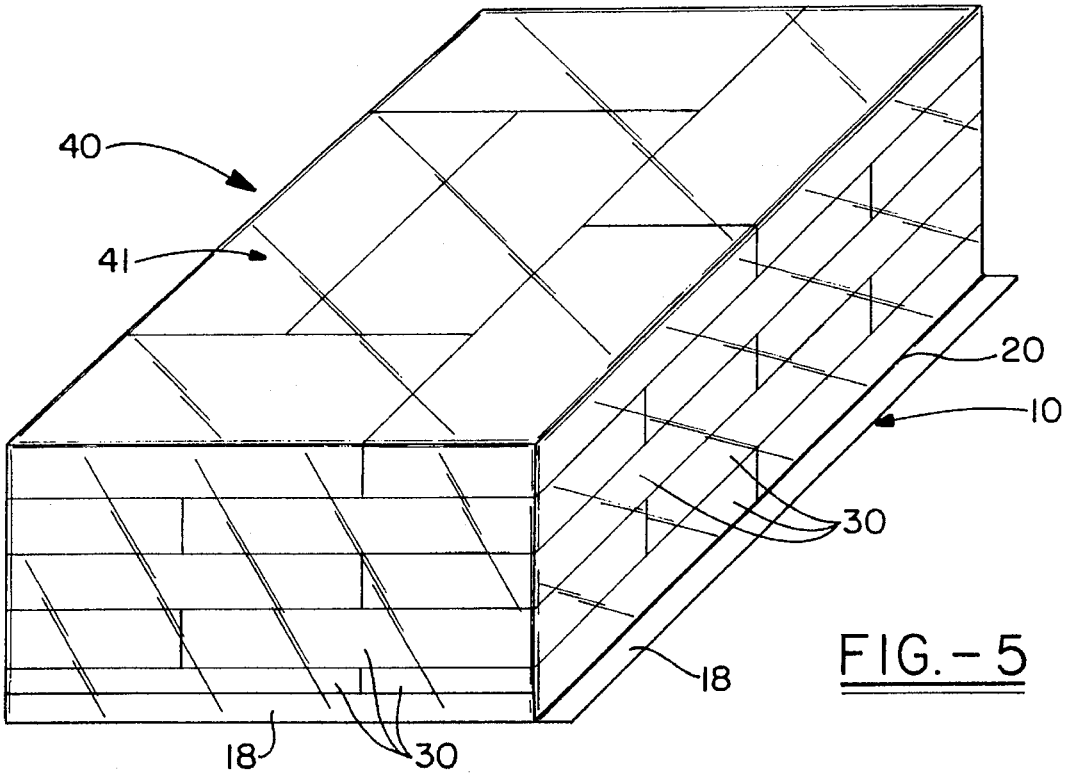
FIG. 5 shows a completed five-layer transport unit of the present invention.

As shown in perspective view in FIG. 5, the plurality of bale units 30 can be properly stacked upon the slip sheet 10, so that the final transport unit 40 is formed by wrapping at least one layer of a stretchable or shrinkable polymeric film around the sides and top of the rectangular solid unit to hold the unit together. The preferred polymeric film is a thin film of a polymer that will orient axially upon application of longitudinal tension. An example of such a polymer is a low density polyethylene. The wrapping process is very well known in the art of materials transport and a variety of machines are available for putting the stretchable film around the transport unit. While not critical to the present invention, it may also be desirable to wrap the individual small bales of rubber crumb with the polymeric film, thereby assisting the bale in retaining its integrity during handling. In wrapping the bales and slip sheet to form the transport unit, it is desirable to wrap the film around the upwardly folded tab portions 18 of the slip sheet, so that some attachment of the slip sheet tab 18 to the transport unit 40 is achieved, as shown in the front left portion of FIG. 5, although this will be recognized as not be necessary to make the invention operative. To make the unit 40 transportable, at least one of the tabs 18 should be left uncovered by the overwrap sheet, as the tab 18 shown on the right front portion of FIG. 5.

Once formed, the transport unit of rubber crumb or sheet must be transported to the point of use. The transport of palletized loads is well known, but the standard forklift-type vehicle used for transport of pallets is not appropriate for use with the transport unit, since the standard fork of such a vehicle would be likely to penetrate the stretch-wrapped bales and it might have difficulty in getting under the slip sheet for a proper lift. However, there is a type of adaptation for a lift-type truck for use with slip sheets and this type of truck would be appropriate for use in this application. An example of such a truck is the push/pull type truck produced by Cascade Corporation of Portland, Oreg., among others. In such a truck, the fork is replaced with a flat horizontal platen and a vertical faceplate that can be moved along the length of the platen. The faceplate has a gripper portion at the lower end thereof for gripping a tab 18 of the slip sheet 10. Once the tab is grasped by the gripper portion, the transport unit can be pulled back onto the platen for carrying. The faceplate can then be moved forward to push the transport unit off of the platen at the desired destination. After the gripper portion's grasp of the tab is released, the platen can be withdrawn from under the slip sheet.

In a similar fashion, the frame units for holding the transport units storage and during transport, at least in "break bulk" transport, are also commercially available. For example, Flexible Material Handling of Cleveland, Ohio, markets a portable rack system under the registered trademark NESTAINER. Each NESTAINER unit comprises a rectangular base with four upstanding legs. The two legs corresponding to the front side of the base are positioned at the corners of the front of the rectangular base, but are spread out slightly wider than the base itself. The two legs corresponding to the rear side of the base are positioned back from the base and inside the length of the base, so that they are closer to each other the front legs. A set of three vertical braces forming a "U" shape top piece is connected to the top ends of the legs. The "U" shape piece is sized to correspond in length and width to the rectangular base, and the connections to the top ends of the legs are identical to the connections of the bottom ends of the legs to the rectangular base. By offsetting the legs in this fashion, the frame units are nestable, providing more convenient storage when not in use. The top of the "U" shape piece and the bottom of the rectangular base are adapted with corresponding surfaces so that the frame units are easily stacked one atop another. The rectangular base has cross members so that it provides support to a slip sheet positioned atop it. In the preferred NESTAINER unit size for this application, the rectangular base would have a front face width of about 64 inches and a depth of about 50 inches, thereby easily accommodating a transport unit being about 54 inches by about 41 inches. The open front face height of each such unit would be tall enough that a transport unit seven bales high could be accommodated therein. This would require a height of about 60 inches to provide the needed 54 inches plus about 10% extra for moving the transport unit in and out. In such an arrangement, therefore, the NESTAINER unit would be able to handle a 30 to 42 bale transport unit.

The NESTAINER units or similar nestable frame units are especially useful in the storage of the transport units and the shipping of the transport units in "break bulk" type ships. However, the frame units, being metal, add weight to the transported mass, so the usual method of transport will be to use the nestable units only for storage. In the preferred method of transport, the transport units are stacked one high in a containerized unit, which may be loaded and unloaded using the same push/pull type lift trucks described further above.

In the method of the present invention, rubber in sheet or crumb form is formed into small bales 30 comprising between seventy and eighty pounds of rubber per bale. Each bale is preferably rectangular and has a preferred size of about 27 inches by about 13.5 inches by about 7.5 inches. These bales 30 are stacked atop a slip sheet 10 as described above, the bales 30 being stacked in an arrangement providing a footprint 12 that is essentially the same size as a rectangular working area of the slip sheet. The preferred stacking arrangement provides from about five to about seven layers of bales with about six bales per layer being also preferred, with a unit 40 having five layers of bales 30 shown. The slip sheet 10 is provided with edge tabs 18 for gripping for transport purposes. The stacked bales and the slip sheet are then wrapped with a stretchable or heat-shrinkable polymeric film to form a rectangular solid transport unit 40. After the wrapping process, the gripping tab 18 on at least side of the slip sheet 10 is not covered by the wrapping film, so that it is accessible to being grasped by a lift truck equipped for push/pull type transport. Once so grasped, the rectangular transport unit may be placed in a nestable frame unit, preferably a nestable frame unit that is stackable at least two and preferable at least four units high. The rectangular transport units are preferably shipped one-high in containerized vessels to minimize the non-rubber material being transported.

The elimination of wood packaging materials from a rubber transport unit can drastically reduce the percentage of non-rubber material in the transport unit. For example, it is shown above that a wood crate weighing 175 pounds and holding 2772 pounds of rubber is approximately 6 percent non-rubber material. If the non-rubber components (slip sheet and wrap materials) of the transport unit of the present invention weigh 30 pounds, the non-rubber material has been reduced to about 1 percent. Additional advantages of the present invention system are achieved by the packaging of the individual bales in plastic bags, which eliminates the use of talc, as known in the prior art. In addition to causing a clean-up problem, talc is being recognized as a possible health safety hazard when it is inhaled on a regular basis.

In another and preferred embodiment of the present invention, a slip sheet having improved grasping tabs and four upstanding walls is formed. A rectangular sheet 60 of the desired plastic material is obtained. To determine the size of the sheet needed, one must first determine the size of the footprint 12 desired, as well as the height of the upstanding walls and the depth of the tabs to be formed. In a typical slip sheet, the desired wall height will be about 4 inches and the desired depth of the tabs will be about four inches. As mentioned above, a typical footprint for the formed slip sheet will be about 54 inches by 41 inches. To obtain the final footprint, the starting sheet should have a width equal to the footprint width 68 plus two times the height of the desired wall plus two times the desired tab depth. Likewise, the starting sheet should have a height equal to the footprint length 66 plus two times the height of the desired wall plus two times the desired tab depth. Based on a width of 54 inches, a height of 41 inches, a wall height of 4 inches and a tab depth of 4 inches, this formula would require a starting sheet that is 54+8+8 or 70 inches wide by 41+8+8 or 57 inches high. Such a sheet 60 is shown in top plan view in FIG. 6.

Figure 6:
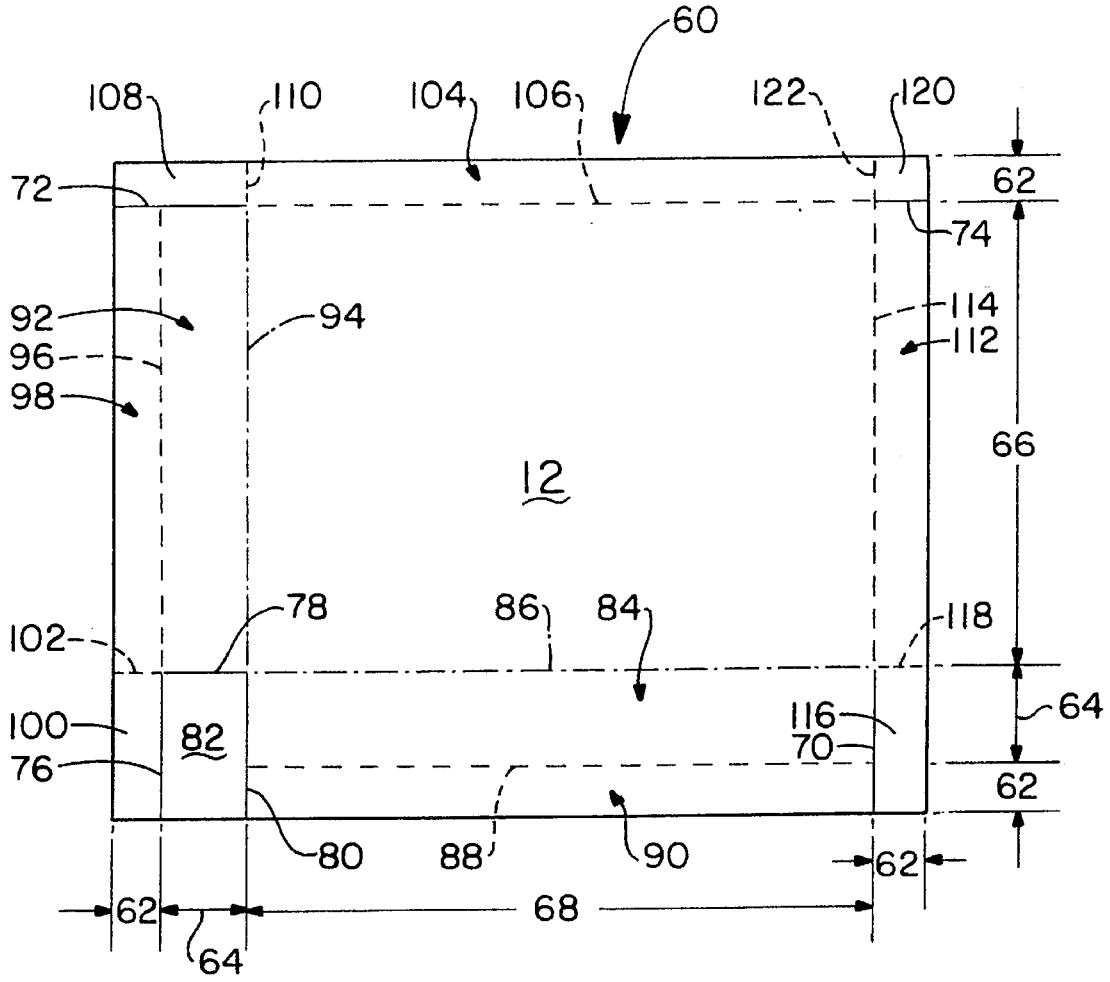
FIG. 6 shows a second embodiment of a slip sheet for transporting goods in unassembled top plan view.

While the following describes a method for assembling the slip sheet having improved grasping tabs and four upstanding walls, it will be understood that other assembly methods are possible and that this method is taught only for illustrative purposes. In FIG. 6, cut lines are shown by solid lines, fold lines are shown by dashed lines and dot-dash lines show registration lines. A first cut 70 is made into the sheet 60. Cut 70 is made one wall height 62 in from the corner. The depth of the cut 70 into the sheet 60 is one wall height 62 plus twice the tab depth, which is shown as 64. A second cut 72 is made in a similar fashion. Cut 74 is made one wall height 62 from a third corner, and this cut has a depth equal to one wall height 62. Cuts 76, 78 and 80 result in removal of a rectangular piece of material 82. Now piece 84, bounded by cuts 70, 80 and registration line 86, is folded over so that fold line 88 lies atop registration line 86. The material along fold line 88 is attached to registration line 86 by thermal welding, stapling or similar attachment means. Then, the portion 90 bounded by cuts 70 and 80 and fold line 88 is folded upwardly to form an upstanding wall. The folded portion between cuts 70 and 80, registration line 86 and fold line 88 forms a compressible tab having a generally airfoil cross-section.

Similarly piece 92, bounded by cuts 72, 78 and registration line 94, is folded over so that fold line 96 lies atop registration line 94. The material along fold line 96 is attached to registration line 94 by thermal welding, polymeric rivets, stapling or similar attachment means. Then, the portion 98 bounded by cuts 72 and 78 and fold line 96 is folded upwardly to form an upstanding wall. The folded portion between cuts 72 and 78, registration line 94 and fold line 96 forms a compressible tab having a generally airfoil cross-section.

The tabs having been formed and two walls 90 and 98 having been formed, portion 100 is folded along line 102, registered atop wall 90 and fastened into place by polymeric rivets, stapling, thermal welding or the like. Then portion 104 is folded upwardly along fold line 106, forming a third upstanding wall. Portion 108 is folded along fold line 110, registered atop wall 98 and fastened into place by polymeric rivets, stapling, thermal welding or the like. Portion 112 is folded upwardly along fold line 114, forming a third upstanding wall. Portion 116 is folded along fold line 118, registered atop wall 90 and fastened into place by polymeric rivets, stapling, thermal welding or the like. Finally, portion 120 is folded along fold line 122, registered atop wall 112 and fastened thereto.

Figure 7:
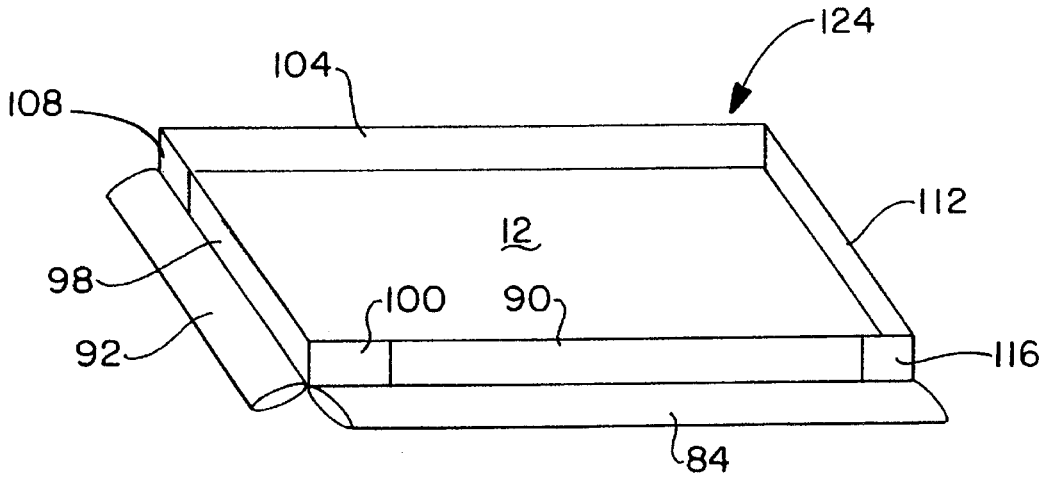
FIG. 7 shows the second embodiment of a slip sheet in assembled perspective view.

Referring now to FIG. 7, the preferred slip sheet 124 of the present invention is shown, with upstanding walls 90, 98, 104 and 112, as well as grasping tabs 84 and 92. Folded portions 100, 108 and 116 that are registered and affixed to walls 90, 98 and 90, respectively, are also shown. The advantage of tabs 84, 92 from those known in the prior art is the airfoil-type cross-section, which permits the grasping fingers on a push/pull type lift truck to obtain a better grip thereupon. Upstanding walls 90, 98, 104, and 112 provide several advantageous functions not known in the prior art. First, the four upstanding walls form a closed perimeter that assists in holding the materials placed upon the slip sheet 124. Because of this, it is not necessary to selectively coat some surfaces of the slip sheet with a slip-resistant material to prevent slippage of the materials on the slip sheet. Second, the upstanding walls are tall enough that they provide protection against damage to the goods on the slip sheet by accidental puncture from the gripping fingers of the push/pull type lift truck. This type of puncture damage is particularly a problem when the goods being stacked on the slip sheet comprise bags of fine solids, such as bags of flour or the like. Third, the upstanding walls provide a surface against which stretch or shrink wrap may be adhered, to help to hold the stretch or shrink wrap in place, when a completed transport bundle has been formed.

The preferred slip sheet 124 of the present invention may be comprised of the materials disclosed above for the first embodiment slip sheet 10, with HDPE being especially preferred. Of particular interest is HDPE in the range of from 40 to 60 mils thick. While slip sheet 10 is disclosed as possibly having projections 14 on the bottom surface, particularly under the footprint 12, these projections will not be needed as much in the preferred slip sheet 124 and may well be omitted.

Figure 8:
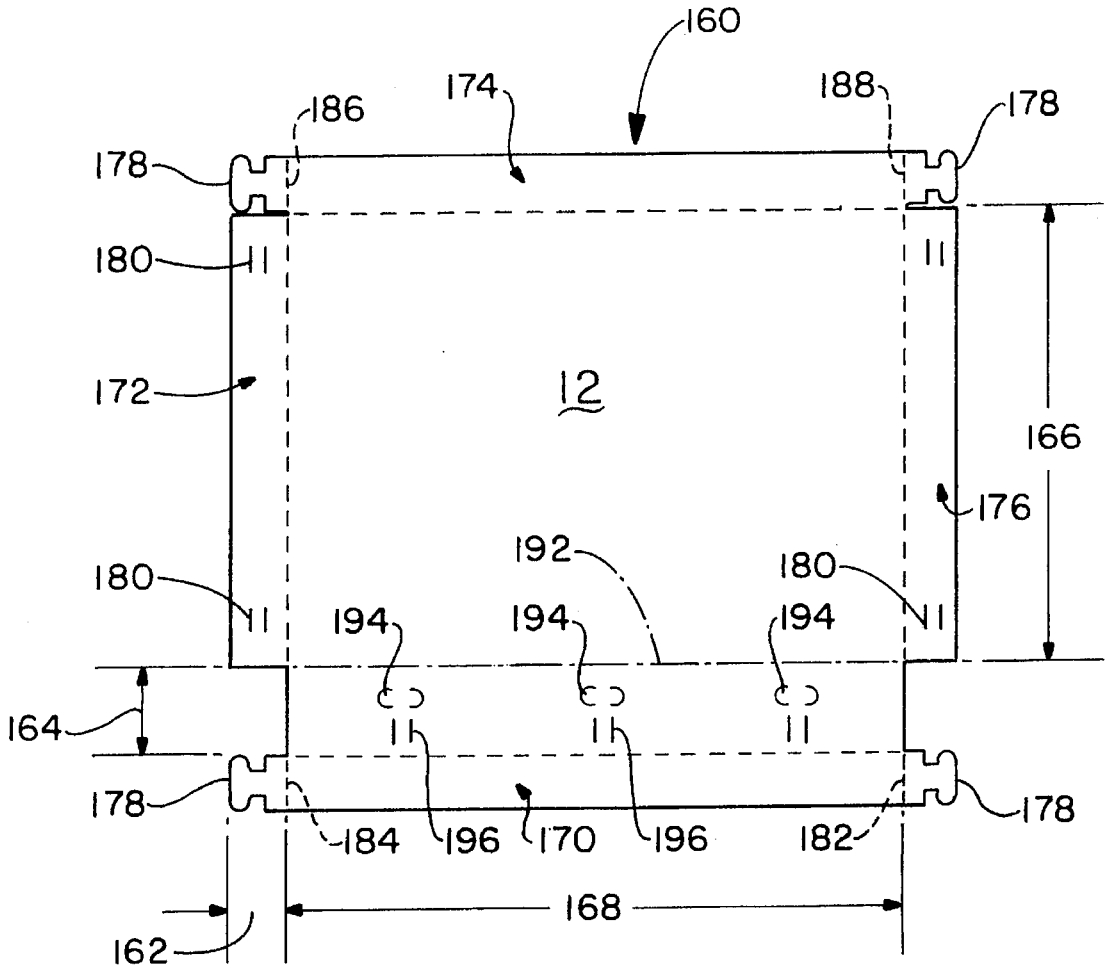
FIG. 8 shows a variation on the second embodiment of a slip sheet for transporting goods in unassembled top plan view.
Figure 9:
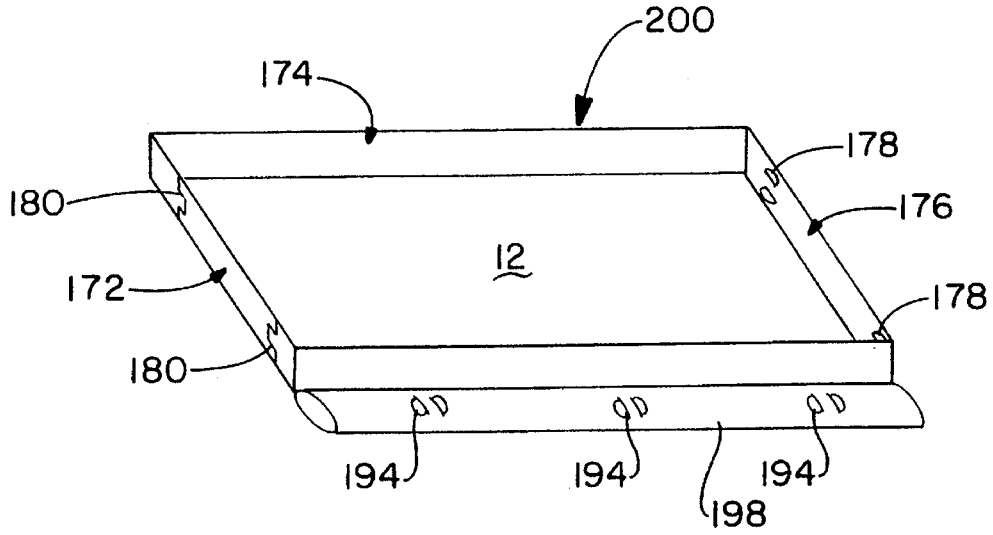
FIG. 9 shows the variation on the second embodiment of the slip sheet in assembled perspective view.

A further variation on the preferred embodiment is presented in FIGS. 8 and 9. In this variation, the embodiment has four upstanding walls, but only one grasping tab. Starting with a rectangular sheet 60 of the desired plastic material as described above, die cutting as described further below yields a blank 160 as shown in top plan view in FIG. 8. In FIG. 8, cut lines are shown by solid lines, fold lines are shown by dashed lines and dot-dash lines show registration lines. The intended slip sheet will have a wall height 162, a tab depth approximately one half of dimension 164, and a footprint 12 defined by length 166 and width 168. Side portions 170, 172, 174 and 176 will form the upstanding walls. Of these side portions, two of them, 170 and 174, have tabbed ends 178, for mating with corresponding slits 180 on side portions 172 and 176, when folds are made along the fold lines 182, 184, 186 and 188. Three of the upstanding walls 172, 174 and 176 are formed by these tabs and mating slits alone. To form the fourth upstanding wall 170, fold line 190 is registered atop registration line 192. To hold the piece in this position, a plurality of C-shaped tabs 194 cut into the piece are mated with a corresponding plurality of slots 196. This piece becomes the compressible tab 198 having a generally airfoil cross-section.

Referring now to FIG. 9, the preferred slip sheet 200 of the present invention is shown in perspective view, with upstanding walls 170, 172, 174 and 176, as well as grasping tab 198.

The preferred slip sheet 124 or 200 of the present invention may be comprised of the materials disclosed above for the first embodiment slip sheet 10, with HDPE being especially preferred. Of particular interest is HDPE in the range of from 40 to 60 mils thick. While slip sheet 10 is disclosed as possibly having projections 14 on the bottom surface, particularly under the footprint 12, these projections will not be needed as much in the preferred slip sheet 124 or 200 and may well be omitted.

While the patent law requirements of presenting the best known embodiment and an enabling disclosure have been achieved by the foregoing discussion, the scope of the invention is not intended to be limited thereto, but should be measured from the appended claims.

What is claimed is:

1. A slip sheet formed from a flat sheet of polymeric material, comprising:

a flat surface for receiving goods, each edge of said flat surface having an upstanding wall portion affixed thereto; and at least one edge of the flat surface having a compressible tab portion extending outwardly therefrom, said compressible tab portion having a convex airfoil-type cross-sectional area to facilitate the grasping of said airfoil shaped tab portion by a push/pull type lift truck;

wherein each said upstanding wall portion is directly attached to an adjacent upstanding wall portion to thus form a closed perimeter to hold goods upon said flat surface of said slip sheet.

2. The slip sheet of claim 1 wherein the flat surface for receiving goods is rectangular.

3. The slip sheet of claim 1 wherein the flat surface for receiving goods is about 54 inches wide by 41 inches long.

4. The slip sheet of claim 1 wherein the slip sheet is formed from a recyclable material.

5. The slip sheet of claim 1 wherein the polymeric material is a previously-processed polymer.

6. The slip sheet of claim 1 wherein the polymeric material is a polyolefin.

7. The slip sheet of claim 1 wherein the polymeric material is a polyester.

8. The slip sheet of claim 1 wherein the slip sheet comprises a material that is non-attractive to insects for eating and nesting.

9. The slip sheet of claim 1 wherein each said upstanding wall portion is directly attached to an adjacent upstanding wall portion by a flat tab of the polymeric material registrable atop a portion of the adjacent upstanding wall portion and affixed thereto.

10. The slip sheet of claim 9 wherein the flat tab is affixed to the adjacent upstanding wall portion by mating a tabbed end on said flat tab with a corresponding set of slits on the adjacent upstanding wall portion.

* * * * *